US008434415B1

(12) United States Patent
Federici et al.

(10) Patent No.: US 8,434,415 B1
(45) Date of Patent: May 7, 2013

(54) DEPLOYABLE FURNITURE TABLE

(71) Applicants: Betsy Federici, Weldon Spring, MO (US); Jamie Hathaway, Weldon Spring, MO (US)

(72) Inventors: Betsy Federici, Weldon Spring, MO (US); Jamie Hathaway, Weldon Spring, MO (US)

( * ) Notice: Subject to any disclaimer, the term of this patent is extended or adjusted under 35 U.S.C. 154(b) by 0 days.

(21) Appl. No.: 13/713,581

(22) Filed: Dec. 13, 2012

Related U.S. Application Data

(60) Provisional application No. 61/570,145, filed on Dec. 13, 2011.

(51) Int. Cl.
*A47B 23/00* (2006.01)

(52) U.S. Cl.
USPC ..... 108/42; 108/38; 297/146

(58) Field of Classification Search ..... 108/47, 108/48, 152, 38, 41; 297/146, 147, 163, 297/173
See application file for complete search history.

(56) References Cited

U.S. PATENT DOCUMENTS

| | | | | | |
|---|---|---|---|---|---|
| 1,781,977 | A | * | 11/1930 | Cummings | 297/146 |
| 1,790,468 | A | * | 1/1931 | Frank et al. | 108/38 |
| 2,132,279 | A | * | 10/1938 | Wicknick et al. | 297/146 |
| 2,249,287 | A | * | 7/1941 | Gearhart et al. | 297/146 |
| 2,619,395 | A | * | 11/1952 | Kent | 108/38 |
| 2,963,078 | A | * | 12/1960 | Ferrelle | 297/146 |
| 3,596,987 | A | * | 8/1971 | Wilson | 297/188.07 |
| 3,717,375 | A | | 2/1973 | Slobodan | |
| 3,795,422 | A | * | 3/1974 | Robinson et al. | 297/146 |
| 4,892,334 | A | * | 1/1990 | Sinclair | 281/45 |
| 5,035,464 | A | | 7/1991 | Spallholtz | |
| 5,081,724 | A | * | 1/1992 | Takahashi et al. | 108/38 |
| 5,842,743 | A | | 12/1998 | Wright | |
| 5,931,527 | A | * | 8/1999 | D'Onofrio et al. | 297/146 |
| 6,758,518 | B2 | * | 7/2004 | Ingram et al. | 297/146 |
| 6,761,398 | B2 | | 7/2004 | Bentley | |
| 7,509,696 | B2 | | 3/2009 | Soto | |
| 7,966,948 | B1 | * | 6/2011 | Galietti | 108/42 |
| 2011/0012393 | A1 | | 1/2011 | Kanthasamy | |

* cited by examiner

*Primary Examiner* — Jose V Chen
(74) *Attorney, Agent, or Firm* — Daniel Boudwin

(57) ABSTRACT

Disclosed is a combination furniture article and table support. The device comprises an article of furniture having an upstanding seatback and a flush-mounted frame therealong. The frame supports a hingeable tabletop that is flush with the seatback when in a stowed state. When deployed, the table is pulled away from the frame, rotated outward and secured within a cavity along the upper interior portion of the frame. This cavity secures over the upper edge of the table and supports the table in a horizontal configuration. The preferred embodiment utilizes a spring and damper element to draw the table into the cavity; however several embodiments are contemplated. The lower underside of the table includes a magnet or ferric material that aligns with a magnet within the lower portion of the frame to retain the table within the frame when stowed.

19 Claims, 4 Drawing Sheets

DEPLOYABLE FURNITURE TABLE

CROSS REFERENCE TO RELATED APPLICATION

This application claims the benefit of U.S. Provisional Application No. 61/570,145 filed on Dec. 13, 2011, entitled "Couch with Flip Table." The above identified patent application is herein incorporated by reference in its entirety to provide continuity of disclosure.

BACKGROUND OF THE INVENTION

1. Field of the Invention

The present invention relates to furniture and deployable tables. More specifically, the present invention pertains to a couch having a deployable and stowable table structure.

Convertible and combination furniture articles are those having deployable features that improve the functionality of the furniture article beyond a mere support or decorative item. Many individuals desire modern furniture solutions that incorporate not only comfort and style, but also incorporate accessories that allow the user to combine functions or integrate different activities into a single furniture item. These accessories range from the very basic to the highly sophisticated, such as different forms of built-in storage, electrical connectivity features such as speakers and lighting controls, increased comfort accessories such as massagers, and deployable and stowable supports such as tables and eating platforms. The latter accessory type includes a broad category of deployable supports for eating upon and resting refreshments or personal items thereupon.

It is not always feasible in some interior spaces to have room for a dining room table or furniture end tables. It can be difficult for those with smaller apartments or houses to arrange both a couch and a table in such a way as to prevent overcrowding. Oftentimes, individuals simply eliminate the table and utilize lap tray tables, which are not always convenient as a stable platform. Elimination of table space also reduces areas upon which to set remotes, drinks, glasses, or other items. These items usually end up being set on the floor beside or in front of the couch, which can make them susceptible to being kicked or knocked over. Additionally, many individuals place narrow tables between a couch and a wall, or behind a couch to support books or other such items. These narrow tables are typically unstable and are prone to easily falling over, and are thus not an ideal solution. Combination furniture articles that include deployable supports are ideal for those who wish to de-clutter their environment, maximize space, and have a stable platform upon which to rest articles.

The present invention pertains to a combination furniture article and a tray table assembly. In a preferred embodiment, a deployable table is stowed along a side of a sofa or chair, where the table remains flush with the furniture exterior surface when stowed and provides a stable, horizontal platform when deployed. The table is deployed from a frame imbedded in the furniture back or side, where a small cavity along the upper portion of the frame retains the table in a deployed state with the aid of retaining elements. The present invention is an ideal replacement for standing tables that are traditionally placed behind furniture items. The present invention provides a readily deployable solution that does not take up much space within a room, while also providing the ability to stow flushly against a furniture exterior for efficient use of space.

2. Description of the Prior Art

Devices have been disclosed in the prior art that relate to deployable table assemblies. These include devices that have been patented and published in patent application publications, and generally relate to seatback trays and convertible furniture items. The following is a list of devices deemed most relevant to the present disclosure, which are herein described for the purposes of highlighting and differentiating the unique aspects of the present invention, and further highlighting the drawbacks existing in the prior art.

Specifically, U.S. Pat. No. 2,619,395 to Kent discloses an adjustable folding table for an automobile seat that comprises a hingeable table assembly having a metal frame and two parallel channel members. A spring loaded latch secures the table in a stowed, upright configuration within the frame, while a support leg supports the table in a horizontal configuration when deployed. The device offers a deployable table within an automobile that slides along the parallel channels into a locked, extended position and supported by the support leg. The device is adapted to extend and retract from the backside surface of a seat. The Kent device discloses a table that slides within a track and is supported by an angled arm. The present invention is preferably a device that requires no additional brace, but rather relies on an internal ledge and retainer that secures an end of the table within an article of furniture when deployed in a horizontal configuration.

Another such device is U.S. Pat. No. 6,761,398 to Bentley, which discloses a stowable table for airplane seats, comprising a seat assembly having a backrest, a stowable table that abuts the backrest when stowed and extends from the backrest when deployed. A first and second arm supports the table as it extends away from the backrest to deploy into a largely horizontal configuration for placement of personal items and refreshments while on a passenger airplane. The Bentley device, while disclosing a fold-out table in conjunction with a furniture article, does not contemplate a flush-mounted furniture table that is pulled upward and away from the article of furniture when deployed and secured using an inwardly directed ledge and securement means.

Finally, U.S. Published Patent Application Publication No. 2011/0012393 to Kanthasamy discloses a sofa having a tray table fold-out mechanism. The device comprises a pair of hinges that attached to a sofa seat deck and provide a hinge point for a tray table. The tray table folds from a vertically stowed position to a horizontally deployed state, while beneath the table is a leg member that supports the distal end of the tray table from the floor. The device of Kanthasamy is one that is adapted to be positioned along one side of a sofa and provide an extendable table therefrom. The present invention, by contrast, provides a structure that is flush with the seatback or side of an article of furniture that provides a deployable table that requires not additional supports and remains flush with the furniture exterior when stowed.

The present invention discloses a new and novel article of furniture having a deployable table from the furniture seatback or side of the furniture. When deployed, the table provides a stable platform to support articles thereon. When stowed, the device is flush with the furniture exterior such that the room is not cluttered. It is submitted that the present invention is substantially divergent in design elements from the prior art, and consequently it is clear that there is a need in the art for an improvement to existing combination furniture articles. In this regard the instant invention substantially fulfills these needs.

SUMMARY OF THE INVENTION

In view of the foregoing disadvantages inherent in the known types of combination furniture articles now present in the prior art, the present invention provides a new furniture article with a deployable table, wherein the same can be utilized for providing convenience for the user when efficiently creating a table support when desired and stowing the table within the furniture interior between uses.

It is therefore an object of the present invention to provide a new and improved combination furniture article that has all of the advantages of the prior art and none of the disadvantages.

It is another object of the present invention to provide a combination furniture article having a deployable and stowable table support that extends therefrom using a simple and stable support frame.

Another object of the present invention is to provide a combination furniture article that comprises a flush-mounted frame that supports the table when in a stowed state.

Yet another object of the present invention is to provide a combination furniture article that comprises a frame having an upper channel that draws the table end thereinto to support the table using a cantilevered construction.

Another objection of the present invention is to provide a combination furniture article that can be deployed using a number of different deployment and retainment means.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
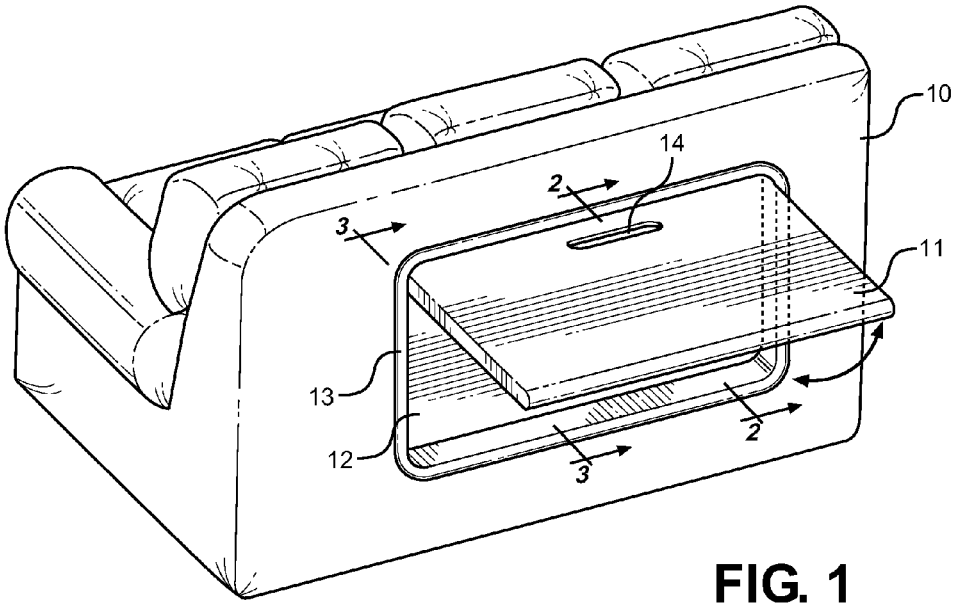
FIG. 1 shows a perspective view of the present invention in a deployed state and supported by a sofa furniture article.

Reference is made herein to the attached drawings. Like reference numerals are used throughout the drawings to depict like or similar elements of the combination furniture article. For the purposes of presenting a brief and clear description of the present invention, the preferred embodiment will be discussed as used for providing a readily deployable tabletop from the side or seatback of a furniture article. The figures are intended for representative purposes only and should not be considered to be limiting in any respect.

Referring now to FIG. 1, there is shown a perspective view of the present invention in a deployed state. The device comprises a frame 12 member having a hingeable table 11 or surface, wherein the frame member provides a housing that surrounds the perimeter of the table 11 and accepts the table 11 within the frame interior. The frame 12 is supported within a side or seatback 10 of the furniture article, providing an internal volume within the furniture interior that equals the table 11 volume such that when the table is stowed and positioned therein, the table 11 does not extend outward from the seatback. The table 11 is hingeably secured to the frame 12 along its upper edge, whereby the table can be rotated outward from the seatback 10 into a horizontal position and locked into position within the frame. The assembly provides a readily deployable table structure from the furniture that provides tabletop space and a stable platform for placing articles thereon. The construction further provides a deployable table that remains flush with the seatback or side 10 of the furniture article when not being used, thereby not consuming any unnecessary space from the room when not required.

The frame 12 is one that is mounted within the furniture such that its outer edge is either flush with the seatback or side surface 10, or slightly protruding therefrom along a perimeter lip 13 about the periphery of the frame. The frame 12 is ideally a shallow housing that accepts the table 11 when stowed and supports the table 11 when in a horizontally deployed state. The frame 12 is one that is designed into the furniture structure such that when the table is deployed, the frame and hinge elements are suitable for supporting the weight of articles placed on the table. The table is preferably supported using a cantilevered configuration, where the upper end of the table 11 is positioned within an interior cavity along the upper portion of the frame 12. The depth of the frame 12 is kept to a minimum to prevent users from feeling the frame 12 when seated on the furniture article. It is herein desired to disclose a combination furniture article that can be designed into the furniture structure or retrofitted thereinto after production. It is not desired to limit the type of furniture article for which will be suitable for the present frame and table structure, but rather to disclose a working assembly that can be deployed on any existing or new furniture.

Figure 2:
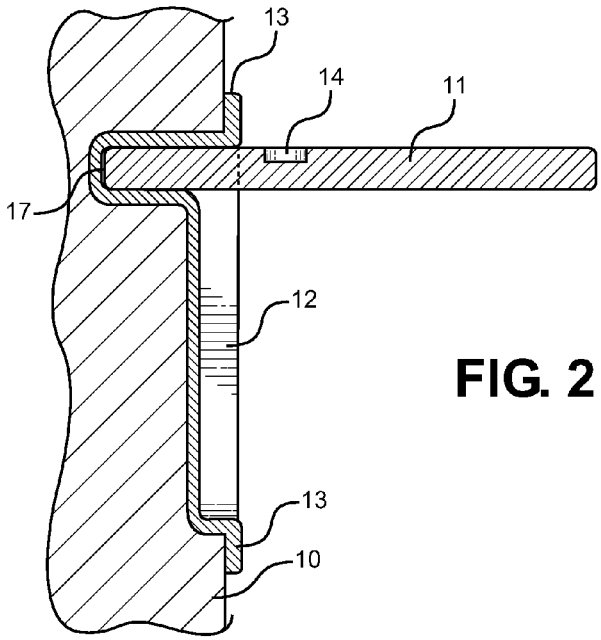
FIG. 2 shows a cross section view of the table midsection in a deployed state.

Referring now to FIG. 2, there is shown a cross section view of the table 11 midsection, highlighting the construction of the frame 12 and the cantilevered support of the table 11 when deployed. The frame 12 comprises an interior volume that accepts the volume of the table when stowed in a vertical configuration and includes an upper interior cavity 17. This cavity 17 is adapted to accept and surround the upper end of the table 11 therein and create an enclosure for the table to bear against when in a horizontal position. To deploy the table 11, a finger grip 14 is provided along the outer surface of the table 11 such that the table can be pulled outward from the interior volume of the frame 12, rotated upward and forced into the upper cavity 17 of the frame, locking the table 11 into a stable, horizontal configuration. The frame is supported by the interior structure of the furniture within its upright seatback or sides 10, where the furniture includes structural members such that the assembly frame 12 may be fastened securely thereto and the members can support the weight of the table and articles placed thereon. The outer portion of the frame is flush with the furniture exterior and may further include a periphery lip 13 about the edge of the frame for decoration.

Figure 3A:
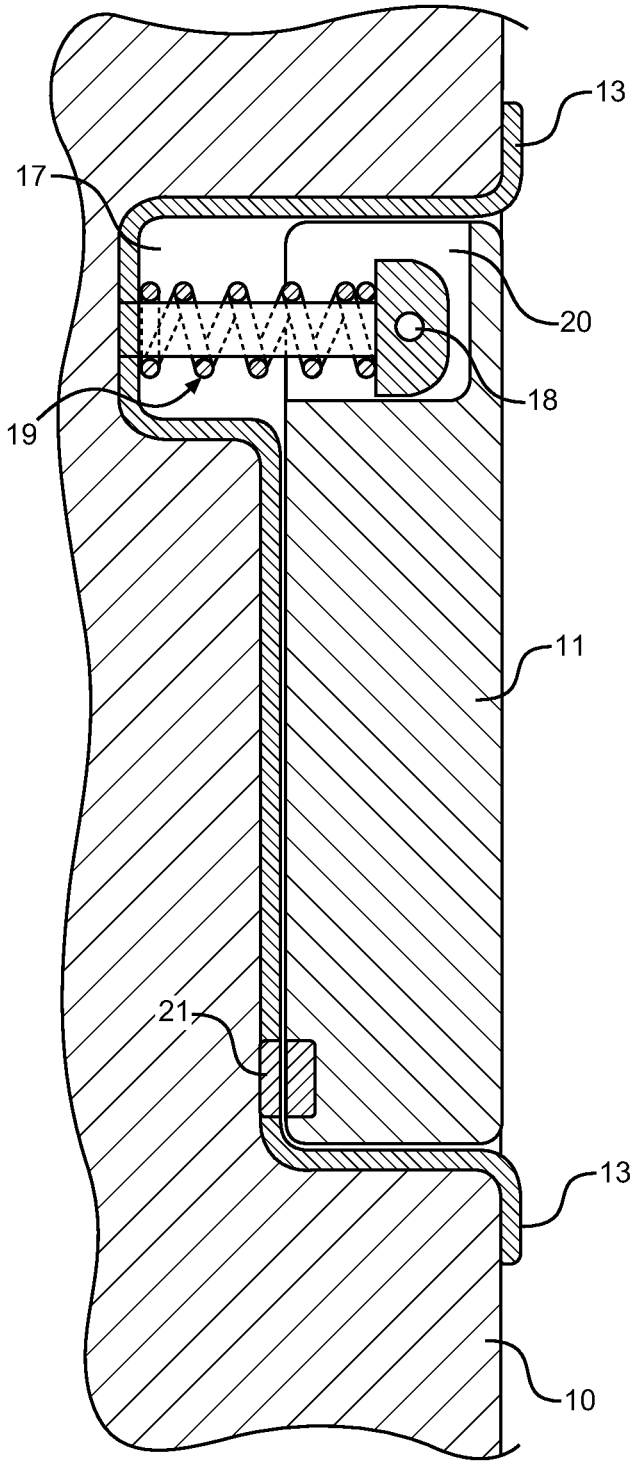
FIG. 3A shows a cross section view of the table end and the preferred embodiment for the table hinge element.

Referring now to FIG. 3A, there is shown a cross section view of the preferred embodiment of the table hinge element. In this embodiment, the table is hinged from a pivot point 18 that is supported by a spring-damper system 19 that allows that table upper portion to be pulled outward from the frame interior volume, rotated upward into a horizontal position and be drawn into the frame upper cavity 17 for support. The spring allows the pivot point 18 to be extended outward from the cavity 17 when accessing and rotated the table 11, while the spring also draws the hinge 18 inward within the cavity 17 when the table 11 is in a horizontal configuration. The spring has a short free length that terminates within the interior cavity 17 such that load is imparted onto the hinge 18 when the table 11 is in a vertical orientation and when the table 11 is being oriented into a horizontal orientation. This draws the table into the cavity, while the damper slows the action of the spring such that the tilting and insertion activities are controlled. The damper element may be a damper element or a compressible material that slows the spring action during deployment. A structural link element may also be positioned in connection with the pivot point to ensure the hinge 18 follows a defined path, while the spring draws the hinge 18 inward towards the cavity 17 and the damper controls the speed of the operation. The link may replace the damper element or may be accompanied by the damper element, as necessary.

The hinge 18 resides within a carve-out or cavity 20 along the outer portions of the upper end of the table such that the table cross section does not interfere with the hinge joint during rotation of the table. When stowed, a magnet element 21 along the interior wall of the frame aligns with a ferric or magnet along the underside of the table such that the table 11 will not exit the frame unless a user applies affirmative pressure on the handle to extract the table and rotate it into a horizontal state.

Figure 3B:
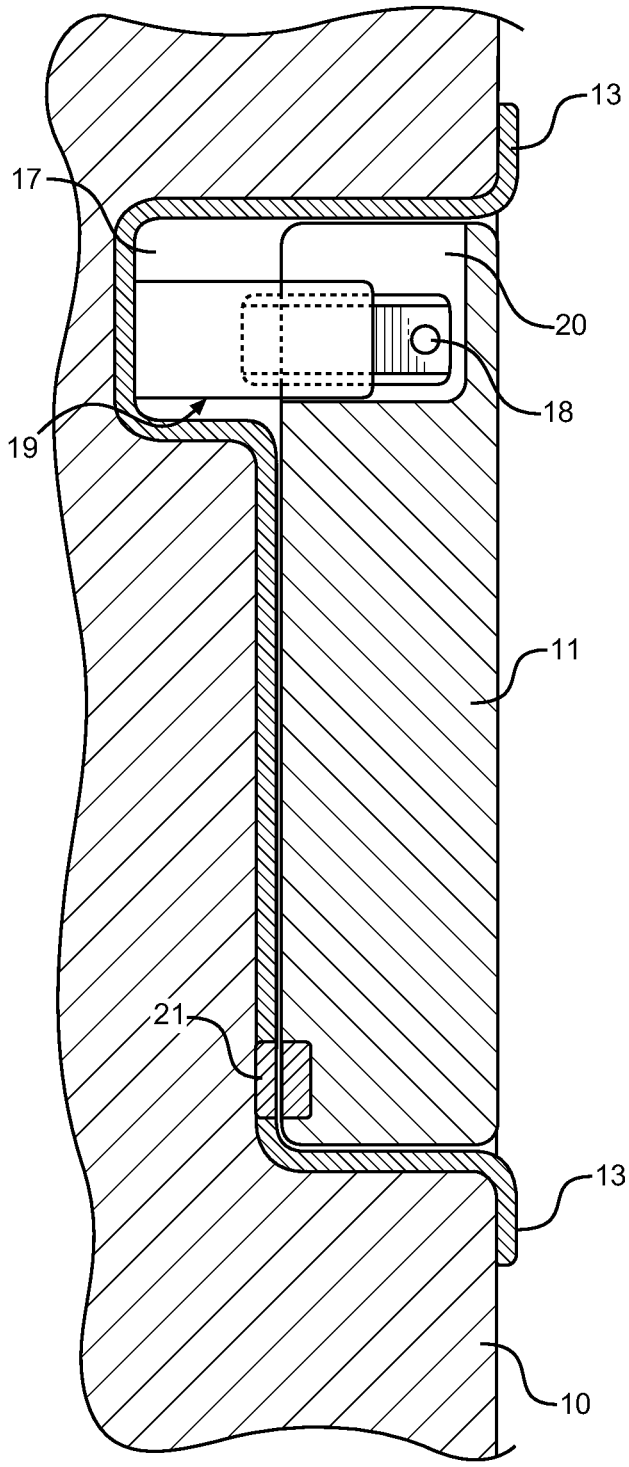
FIG. 3B shows a cross section view of the table end and an alternate embodiment for the table hinge element.

Referring now to FIG. 3B, there is shown a cross section view of an alternate embodiment of the present invention hinge mechanism. In this embodiment, the hinge 18 is supported by a furniture slider or sliding link 19 that that incorporates telescoping members to allow the hinge 18 to be pulled outward from the frame cavity 17 and forced thereinto when the table 11 is being withdrawn from the frame and its end is being forced into the cavity 17. The configuration of the table 11 remains the same as the preferred embodiment, where a carve-out 20 is provided to allow rotation of the table and clearance for the hinge 18 and link 19. The length of the table 11 fits within the height of the frame, while the frame depth accepts the width of the table 11 when the table is stowed therein. To prevent the table from rotating outward from the frame when stowed, the same magnet 21 connection prevents the lower portion of the table from swinging out of the frame. This is particularly useful for furniture seatbacks and sides that are not perfectly upright, but include an angle that would naturally cause the table to swing outward from the frame and into a vertical orientation to achieve equilibrium.

Figure 3C:
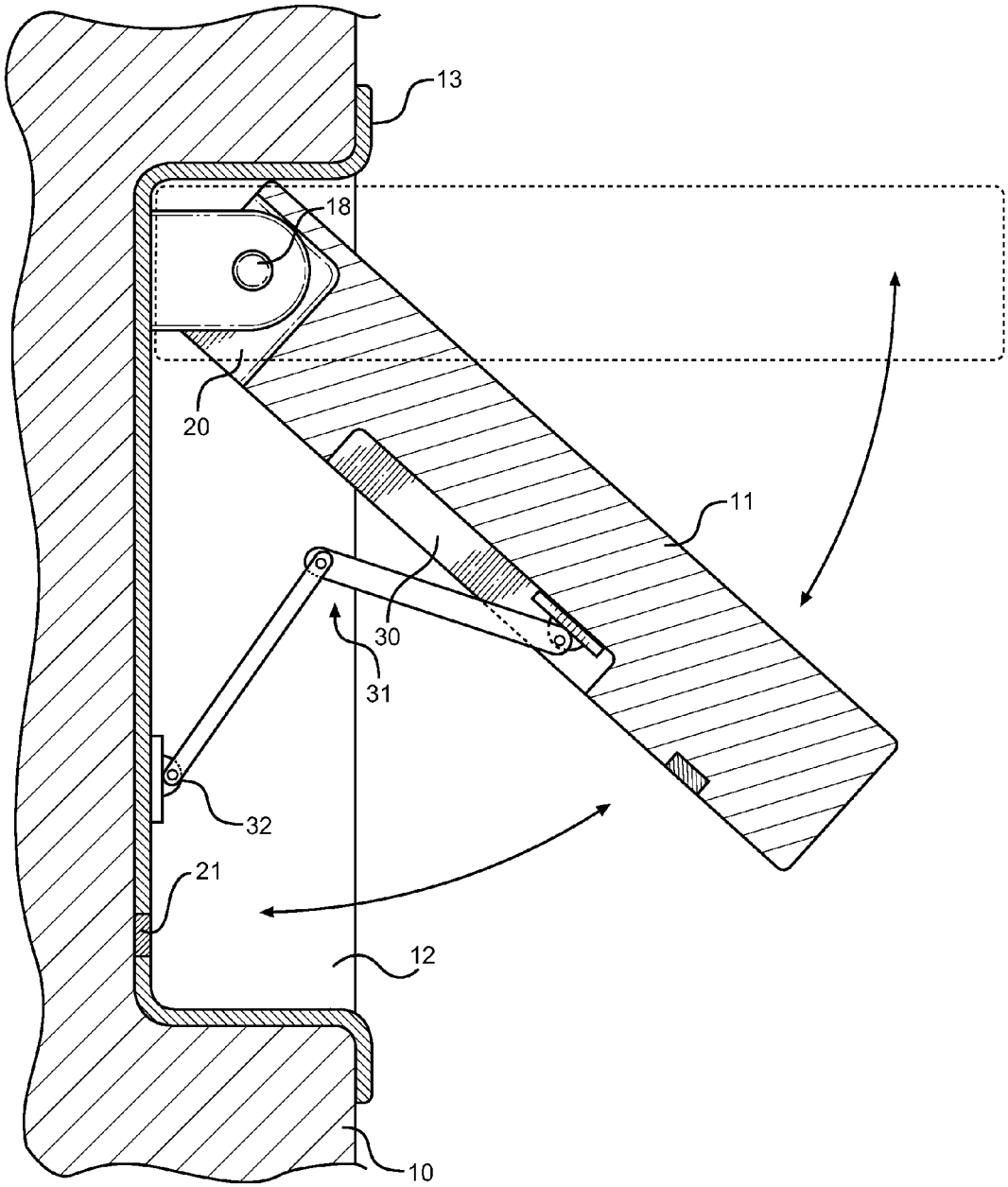
FIG. 3C shows a cross section view of the table end and an alternate embodiment for the table hinge and support element.

Referring finally to FIG. 3C, there is shown yet another embodiment of the frame and hinge mechanism of the present invention. In this embodiment, a hingeable brace 31 and a static pivot point 18 such that the table is capable of rotation only. The frame is shallower that the preferred embodiment in that it does not require an internal support cavity; however the table 11 requires an additional support brace 31 to support the table 11 in a horizontal position. The brace includes a first and second linkage that rotatably connects 32 along the interior wall of the frame 12 and to the underside surface of the table 11 within a channel 30. The linkages are lockable when aligned in an extended position, where the extended position is achieved when the table 11 is in a horizontal position. The lock allows the table 11 to support the weight of objects placed thereon without collapsing and rotating downward. The linkages pivot into a condensed, overlapping position when the table 11 is rotated into the interior of the frame, wherein the condensed linkages fit within the channel 30 along the underside of the table 11. The upper hinge pivot point 18 is positioned within the same carve-out 20 of the preferred embodiment, allowing rotation of the table from a vertical to a horizontal configuration. Finally, the magnetic securement 21 of the table when stowed retains the table within the frame interior 12 when not deployed.

The present invention provides a user with a folding table that does not require a user to make permanent space within the user's room. The device comprises a combination furniture item having a built-in folding table. The seatback or side of the furniture includes a folding table that is housed within a frame interior of the furniture article. The table folds downward and rests flush against the back or side of the couch, thereby giving the appearance of being part of the couch. The present invention affords convenience for a user in small living spaces or for users who desire a simple and convenient place to set their glasses, drinks, or other small items when sitting on the furniture article. The table can additionally be used as a place to set decorations, room accents, or hors d'oeuvres during gatherings within the home. The device comprises a frame having a depth that is placed within the interior of a furniture article whereby the frame is secured and provides a readily deployable and stowable table structure for convenience of the user.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A deployable furniture table, comprising:

a frame having an interior volume defined by an upper sidewall, a lower sidewall, an interior surface, sidewalls and a table support cavity;

a table having an upper end, a lower end, an interior surface, an exterior surface, and a thickness;

said table thickness adapted to fit within said frame interior volume such that said table exterior surface aligns with said frame sidewall termination when said table is in a vertical orientation;

said table support cavity being located along said frame interior surface adjacent to said upper surface to allow said table thickness to enter thereinto for support when said table is in a horizontal orientation;

at least one table hinge pivotably connecting said table upper end to said frame and allowing said table to rotate from a horizontal to a vertical position, said hinge being secured to said frame within said table support cavity;

said hinge securement means being capable of movement into and out of said table support cavity, and comprising an extendable member, a spring and damper element connecting said hinge to said table support cavity to draw said hinge into said table support cavity when said table is in a horizontal and vertical position.

2. The device of claim 1, wherein said hinge securement means further comprises an extendable member and spring to draw said hinge into said table support cavity when said table is in a horizontal and vertical position.

3. The device of claim 1, wherein said table interior surface and said frame interior surface further comprise an aligned securement element to prevent said table from readily pivoting about said hinge when said table is within said frame.

4. The device of claim 3, wherein said securement element further comprises a magnetic connection between said table and said frame.

5. The device of claim 1, wherein said at least one hinge comprises a first and second hinge secured to a first and second carve-out along said table upper end corners.

6. The device of claim 1, wherein said table exterior surface further comprises a user hand grip for rotating and handling said table.

7. The device of claim 1, wherein said frame is secured within a furniture seatback and said frame is flush with said seatback outer surface.

8. The device of claim 1, wherein said frame is secured within a side of a furniture article and said frame is flush with said side outer surface.

9. The device of claim 1, wherein said frame is secured within a furniture seatback and said frame further comprises a periphery lip perpendicular to said frame sidewalls, upper and lower surface that aligns with said furniture seatback outer surface.

10. A deployable furniture seatback table, comprising:

a frame having an interior volume defined by an upper sidewall, a lower sidewall, an interior surface, and sidewalls;

a table having an upper end, a lower end, an interior surface, an exterior surface, and a thickness;

said table thickness adapted to fit within said frame interior volume such that said table exterior surface aligns with said frame sidewall termination when said table is in a vertical orientation;

at least one table hinge pivotably connecting said table upper end to said frame and allowing said table to rotate from a horizontal to a vertical position;

a locking hingeable brace having a first and second pivoting link connected between said frame interior surface and said table interior surface, said brace supporting said table when in a horizontal orientation and collapsing when said table is in a vertical position.

11. The device of claim 10, wherein said brace links fit within a channel along said table interior surface when said table is in a vertical position.

12. The device of claim 10, wherein said table interior surface and said frame interior surface further comprise an aligned securement element to prevent said table from readily pivoting about said hinge when said table is within said frame.

13. The device of claim 12, wherein said securement element further comprises a magnetic connection between said table and said frame.

14. The device of claim 10, wherein said at least one hinge comprises a first and second hinge positioned within a first and second carve-out along said table upper end corners.

15. The device of claim 10, wherein said table exterior surface further comprises a user hand grip for rotating and handling said table.

16. The device of claim 10, wherein said frame is secured within a furniture seatback and said frame is flush with said seatback outer surface.

17. The device of claim 10, wherein said frame is secured within a side of a furniture article and said frame is flush with said side outer surface.

18. The device of claim 10, wherein said frame is secured within a furniture seatback and said frame further comprises a periphery lip perpendicular to said frame sidewalls, upper and lower surface that aligns with said furniture seatback outer surface.

19. A deployable furniture table, comprising:

a frame having an interior volume defined by an upper sidewall, a lower sidewall, an interior surface, sidewalls and a table support cavity;

a table having an upper end, a lower end, an interior surface, an exterior surface, and a thickness;

said table thickness adapted to fit within said frame interior volume such that said table exterior surface aligns with said frame sidewall termination when said table is in a vertical orientation;

said table support cavity being located along said frame interior surface adjacent to said upper surface to allow said table thickness to enter thereinto for support when said table is in a horizontal orientation;

at least one table hinge pivotably connecting said table upper end to said frame and allowing said table to rotate from a horizontal to a vertical position, said hinge being secured to said frame within said table support cavity;

said hinge securement means being capable of movement into and out of said table support cavity, and comprises a telescoping link connecting said hinge to said table support cavity to allow said hinge to be positioned within said table support cavity and drawn therefrom when said table is in a horizontal and vertical position.

* * * * *